US006589060B2

(12) United States Patent
Yamada

(10) Patent No.: US 6,589,060 B2
(45) Date of Patent: Jul. 8, 2003

(54) ELECTRIC CONNECTION BOX AND METHOD OF PRODUCING ELECTRIC CONNECTION BOX

(75) Inventor: Hiroaki Yamada, Shizuoka (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 10/067,327

(22) Filed: Feb. 7, 2002

(65) Prior Publication Data

US 2002/0106916 A1 Aug. 8, 2002

(30) Foreign Application Priority Data

Feb. 8, 2001 (JP) ..... 2001-032415

(51) Int. Cl.[7] ..... H01R 12/00
(52) U.S. Cl. ..... 439/76.2; 439/715
(58) Field of Search ..... 439/76.2, 949, 439/701, 715, 717, 712, 718, 716, 709, 710, 711; 174/52.1, 59; 220/3.92, 3.94; 29/876, 878

(56) References Cited

U.S. PATENT DOCUMENTS 4,611,879 A * 9/1986 Bullard ..... 439/717
5,741,161 A * 4/1998 Cahaly et al. ..... 439/709
6,290,551 B1 * 9/2001 Nguyen ..... 439/724

FOREIGN PATENT DOCUMENTS

JP 10-229621 8/1998
JP 11-205952 7/1999

* cited by examiner

*Primary Examiner*—Ross Gushi
(74) *Attorney, Agent, or Firm*—Sughrue Mion, PLLC

(57) ABSTRACT

In an electric connection box-producing method, block members (2) for connecting electrical circuit parts are provided on a mounting frame (4), and this method includes a block member-molding step of molding individual block members (2) separate from one another, a block member-combining step of arranging the plurality of block members (2) in the irrespective predetermined positions, and welding these block members together to form a block assembly (3), and a block assembly-mounting step of fixedly securing the block assembly (3) to the mounting frame (4).

5 Claims, 4 Drawing Sheets

ELECTRIC CONNECTION BOX AND METHOD OF PRODUCING ELECTRIC CONNECTION BOX

BACKGROUND OF THE INVENTION

The present invention relates to an electric connection box used in the concentrated connection of electric wires in an automobile or the like and to a method of producing the electric connection box, and more particularly to an electric connection box provided with connection blocks for circuit parts such as a relay and a fuse and to a method of producing the electric connection box.

FIG. 6 shows one example of related electric connection boxes. In this electric connection box 1A, a plurality of cavities (connection blocks) 16 for connecting electrical circuit parts, such as a relay and a fuse, are provided in a mounting frame 15. In the production of this electric connection box 1A, the mounting frame 15 and the cavities 16 are molded integrally with each other, using a mold.

In the above producing method in which the mounting frame 15 and the cavities 16 are molded integrally with each other, the mold is large in size, and is complicated. Besides, since the mounting frame 15 has the predetermined shape, this mounting frame can not be used in other vehicles, and each time the vehicle is changed, a new mold need to be formed. Therefore, there were encountered problems that time is required for producing such a new mold, which was the cause of the increased cost, and that this method lacks the general-purpose ability.

SUMMARY OF THE INVENTION

This invention has been made in order to solve the above problems, and an object of the invention is to provide an electric connection box and a method of producing the electric connection box, in which individual block members and a mounting frame are molded separately from each other, and with this method, only a mold for the mounting frame is formed for each vehicle, and merely by doing so, this method can adapt to all vehicles, and therefore the costs for the molds are reduced, and besides this method is adaptable to various kinds of vehicles, and therefore has a high general-purpose ability.

In order to solve the aforesaid object, the invention is characterized by having the following arrangement.

(1) A method of producing an electric connection box comprising:

molding a plurality of block members, for connecting electrical circuit parts, separate from one another;

arranging the plurality of block members in their respective predetermined positions to form a block assembly; and fixing the block assembly to a mounting frame to produce the electric connection box.

(2) The method according to (1), wherein the plurality of block members are respectively provided with mounting seats which are formed on lower sides thereof, and are welded together.

(3) The method according to (2), wherein each of the mounting seats includes mounting piece portions projecting from a periphery thereof, and a step-like notched portion is formed in an upper surface or a lower surface of the mounting piece portion, and the notched portions of the adjacent block members are mated with each other, and are welded together.

(4) The method according to (2), wherein the arranging step includes a step of welding the mounting seats of the adjacent block members together.

(5) The method according to (2), wherein a gap is formed between the mounting seats of the adjacent block members.

(6) The method according to (1), wherein the fixing step includes a step of welding the block assembly to the mounting frame.

(7) An electric connection box comprising:

a mounting frame; and a plurality of block members which are individually molded and assembled together to form a block assembly, wherein the block assembly is fixed to the mounting frame after the block assembly is formed.

(8) The electric connection box according to (7), wherein the plurality of block members are respectively provided with mounting seats which are formed on lower sides thereof.

(9) The electric connection box according to (8), wherein each of the mounting seats includes mounting piece portions projecting from a periphery thereof, and a step-like notched portion is formed in an upper surface or a lower surface of the mounting piece portion, and the notched portions of the adjacent block members are mated with each other and are welded together.

DETAILED DESCRIPTION OF PREFERRED EMBODIMENTS

Figure 3:
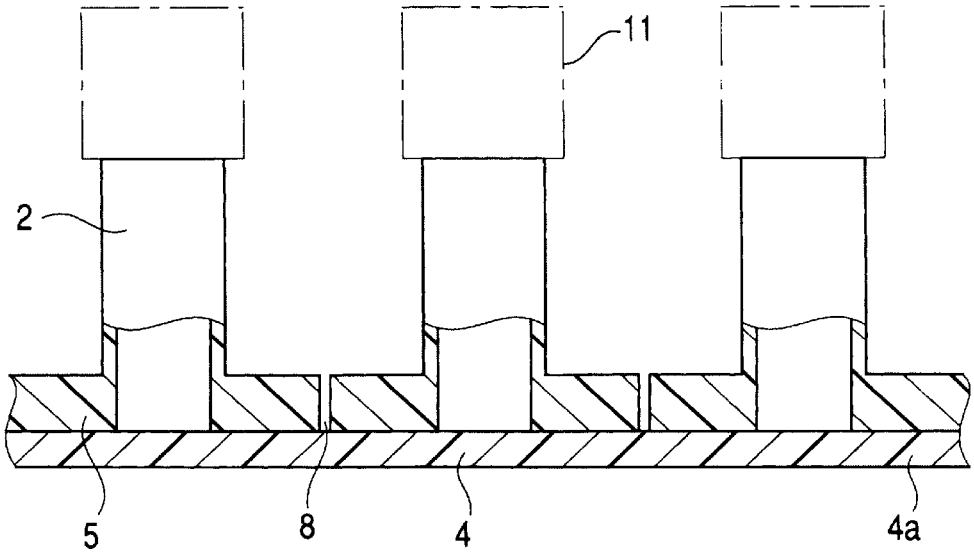
FIG. 3 is a partial vertical cross-sectional view in FIG. 2.
Figure 4:
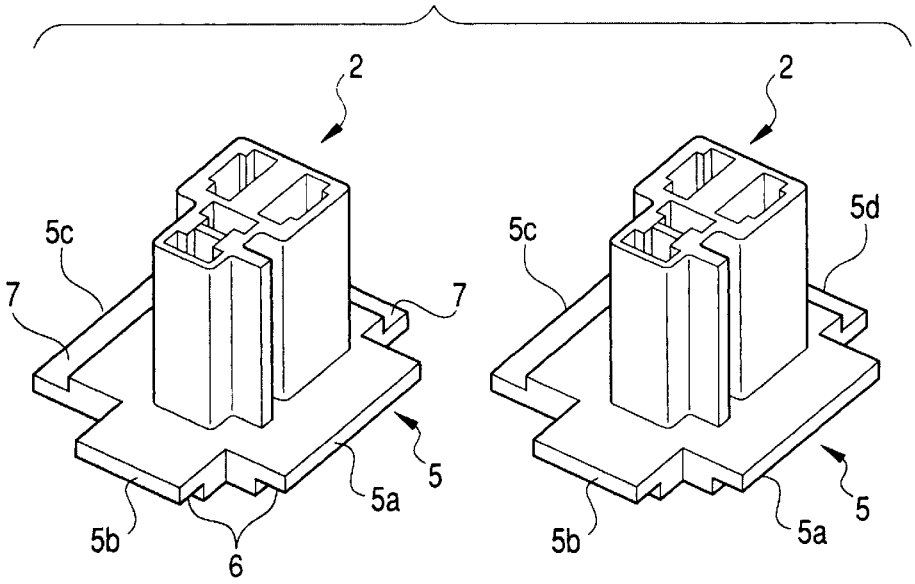
FIG. 4 is a perspective view showing block members in a second embodiment of an electric connection box-producing method of the invention.
Figure 5:
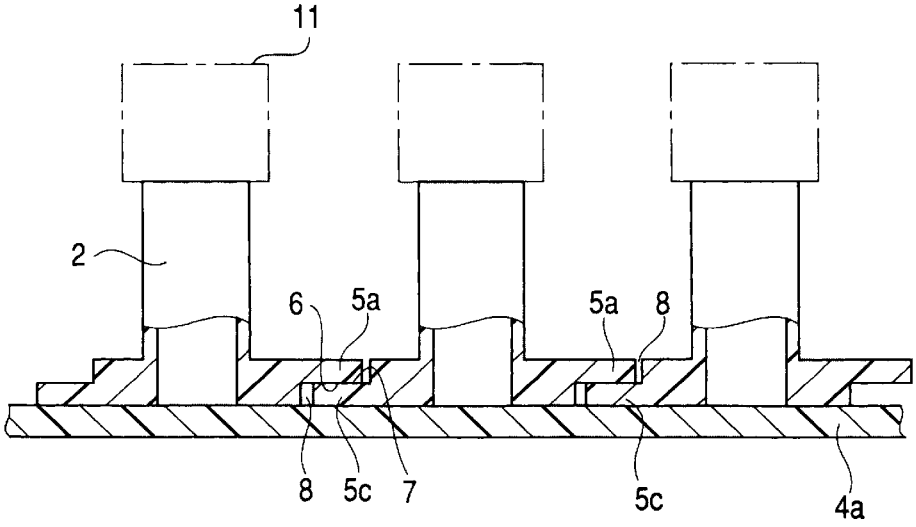
FIG. 5 is a partial vertical cross-sectional view in FIG. 4.
Figure 6:
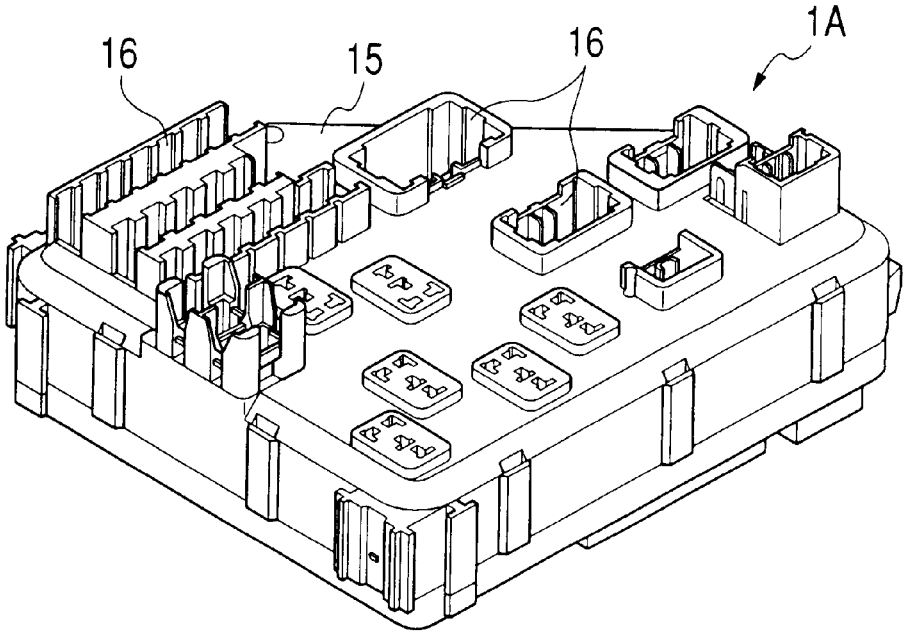
FIG. 6 (PRIOR ART)
FIG. 6 is a perspective view of a related electric connection box.

Preferred embodiments of an electric connection box and a method of producing it according to the present invention will now be described in detail with reference to FIGS. 1 to 5. FIG. 1 is a perspective view showing the first embodiment of the electric connection box-producing method of the invention, FIG. 2 is a perspective view of a produced electric connection box of FIG. 1, FIG. 3 is a partial vertical cross-sectional view in FIG. 2, FIG. 4 is a perspective view showing block members in the second embodiment of the electric connection box-producing method of the invention, and FIG. 5 is a partial vertical cross-sectional view in FIG. 4.

Figure 1A:
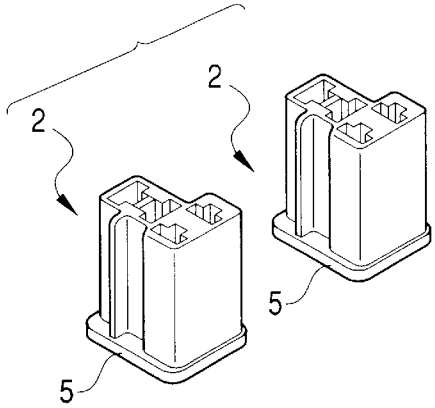
FIG. 1 is a perspective view showing a first embodiment of an electric connection box-producing method of the invention.
Figure 1B:
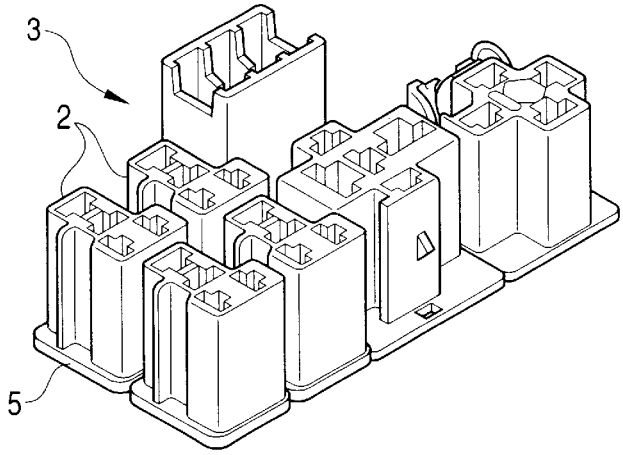
Figure 1C:
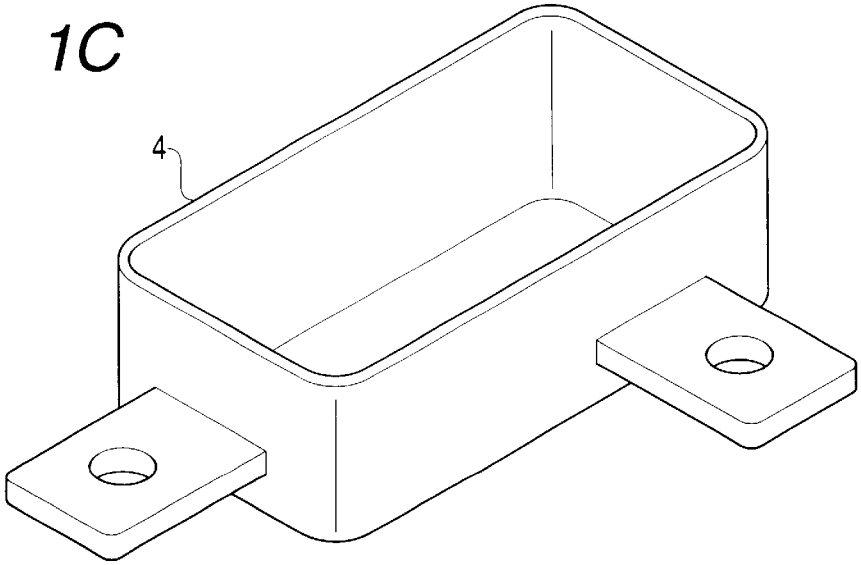
Figure 2:
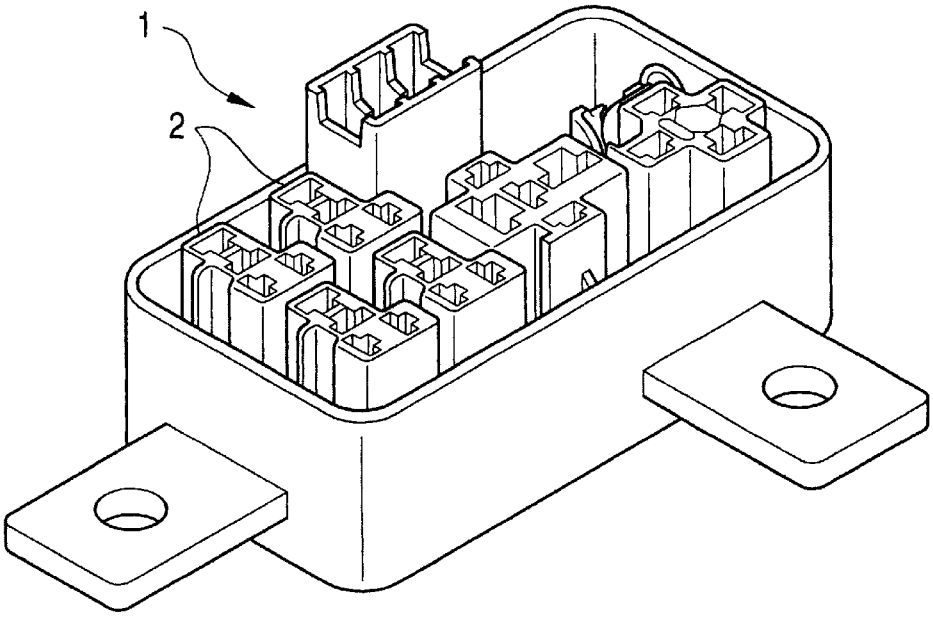
FIG. 2 is a perspective view of a produced electric connection box of FIG. 1.

The electric connection box-producing method according to the embodiment of the invention comprises a block member-molding step of molding individual block members 2 (separate from one another) for electric wiring as shown in FIG. 1A, a block member-combining step of arranging the plurality of block members 2 in their respective predetermined positions, and combining and uniting them together to form a block assembly 3 as shown in FIG. 1B, and a block assembly-mounting step of inserting the block assembly 3 into a separately-molded mounting frame 4 shown in FIG. 1C, and fixedly securing this block assembly to the mounting frame, thereby producing the electric connection box 1 shown in FIG. 2.

The block member 2 is used for connecting an electrical circuit part, such for example as a relay 11 (see FIG. 3) and a fuse, and performs the same function as that of the related cavity 16. Although only one kind of block members are shown in FIG. 1A, there are produced several kinds of block members corresponding in shape to the electrical circuit members (such as a relay and a fuse) which are to be connected thereto. Many such block members 2 are molded in the block member-molding step, and are stored.

In the block member-combining step, the plurality of block members 2, each having a mounting seat 5 formed integrally on a lower side thereof, are arranged in their respective predetermined positions, and are joined together into a configuration conforming to the shape of the mounting frame 4, and are welded together, for example, by ultrasonic waves, thereby forming the block assembly 3 shown in FIG. 1B.

In the block assembly-mounting step, the block assembly 3 is inserted into the mounting frame 4, and is fixed to this mounting frame by fixing means such as welding, thereby forming the electric connection box 1 shown in FIG. 2.

Preferably, a gap 8 is formed between edge surfaces of the adjacent mounting seats 5 so as to absorb the deformation of the mounting seats 5 due to heat (see FIG. 3). This gap 8 can be formed, for example, by forming projections on the edge surface of the mounting seat 5 at intervals.

In the above method of producing the electric connection box 1, although the block assembly 3 of FIG. 1B is formed and then is fitted into the mounting frame 4, there may be used a method in which the individual block members 2 are inserted into the mounting frame 4, and are assembled together to form the block assembly 3 in the mounting frame 4, and thereafter the mounting seats 5 are welded directly to a bottom portion 4*a* of the mounting frame 4 as shown in FIG. 3.

As described above, in the electric connection box-producing method of this embodiment, the individual, separate block members (structural members) 2 and the mounting frame 4 are molded separately from each other, and the block members 2 are arranged in their respective predetermined positions in the mounting frame 4, and are fixedly secured thereto, thereby forming the desired electric connection box.

Therefore, a mold for the block members 2 need only to be formed once while only a mold for the mounting frame 4 is formed according to the kind of vehicle, and by doing so, this method can adapt to all kinds of vehicles, and therefore the time, required for forming the molds, is reduced, so that the costs for the molds can be reduced.

FIGS. 4 and 5 show the second embodiment of the electric connection box-producing method according to the invention.

In this embodiment, mounting piece portions 5*a*, 5*b*, 5*c* and 5*d* project respectively in four directions from a mounting seat 5 of each of block members 2 molded in a block member-molding step. Step-like notched portions 6 are formed respectively in lower surfaces of the mounting piece portions 5*a* and 5*b* projecting respectively in two directions, while step-like notched portions 7 are formed respectively in upper surfaces of the mounting piece portions 5*c* and 5*d* projecting respectively in the other two directions.

As shown in FIG. 5, in a block member-combining step, the mounting seats 5 are disposed in overlapping relation to each other, with the corresponding notched portions 6 and 7 mated with each other, and are welded together by ultrasonic waves or the like, thereby forming a block assembly 3 (see FIG. 1) comprising an arbitrary number of block members 2 combined together into a configuration corresponding to the shape of the mounting frame 4. Preferably, a gap 8 is formed between butting edge surfaces of the mounting piece portions 5*a* to 5*d*.

Then, in a block assembly-mounting step, the block assembly 3 (see FIG. 1) is inserted into the mounting frame 4, and is welded thereto.

In this embodiment, also, there may be used a method in which the individual block members 2 are inserted into the mounting frame 4, and are assembled together to form the block assembly 3, and thereafter the mounting seats 5 are welded directly to a bottom portion 4*a* of the mounting frame 4 as shown in FIG. 5.

As described above, in the electric connection box-producing method of this embodiment, the mounting piece portions 5*a* to 5*d* are disposed in overlapping relation, and are welded together in the block member-combining step, and therefore the joint strength between the block members 2 can be increased, and there can be obtained by the electric connection box which exhibits a high durability against thermal deformation and vibration.

As described above, the electric connection box and the method of producing it according to the present invention comprise the block member-molding step of molding the individual block members separate from one another, the block member-combining step of arranging the plurality of block members in their respective predetermined positions to form the block assembly, and the block assembly-mounting step of fixedly securing the block assembly to the mounting-frame.

Therefore, when a mold for the block members is once formed, this method can adapt to all kinds of vehicles by forming only a mold for the mounting frame according to the kind of vehicle. Therefore, there is no need to form another mold for the block members, which requires much time, and the production cost can be reduced.

The mounting seat is formed integrally on the lower side of the block member, and the mounting seats are welded together, and by doing so, the block assembly of a high strength can obtained.

The notched portions, formed in the upper surface or the lower surface of the mounting piece portions of the mounting seats, are mated with each other, and are welded together, and by doing so, the block assembly of a higher strength can be obtained.

According to the electric connection box of the present invention, a plurality of block members which are individually molded are arranged in a predetermined position to form a block assembly, and then the block assembly is fixed to a mounting frame. Therefore, when molds for molding the respective block members are made once, only mold for molding the mounting frame is necessary to be made according to a type of the vehicle, thereby the production cost can be reduced, and the electric connection box which has general versatility and can be adapted to various kinds of the vehicles can be provided.

What is claimed is:

1. A method of producing an electric connection box comprising:

molding a plurality of block members, for connecting electrical circuit parts, separate from one another;

arranging the plurality of block members in their respective predetermined positions to form a block assembly; and fixing the block assembly to a mounting frame to produce the electric connection box, wherein the plurality of block members are respectively provided with mounting seats which are formed on lower sides thereof, and are welded together and wherein each of the mounting seats includes mounting piece portions projecting from a periphery thereof, and a step-like notched portion is formed in an upper surface or a lower surface of the mounting piece portions, and the notched portions of the adjacent block members are mated with each other, and are welded together.

2. The method according to claim 1, wherein the arranging step includes a step of welding the mounting seats of the adjacent block members together.

3. The method according to claim 1, wherein the fixing step includes a step of welding the block assembly to the mounting frame.

4. A method of producing an electric connection box comprising:

molding a plurality of block members, for connecting electrical circuit parts, separate from one another;

arranging the plurality of block members in their respective predetermined positions to form a block assembly; and fixing the block assembly to a mounting frame to produce the electric connection box, wherein the plurality of block members are respectively provided with mounting seats which are formed on lower sides thereof, and are welded together, and, wherein a gap is formed between the mounting seats of the adjacent block members.

5. An electric connection box comprising:

a plurality of block members which are individually molded and assembled together to form a block assembly; and a mounting frame to which the block assembly is fixed after the block assembly is formed, wherein the plurality of block members are respectively provided with mounting seats which are formed on lower sides thereof, and wherein each of the mounting seats includes mounting piece portions projecting from a periphery thereof, and a step-like notched portion is formed in an upper surface or a lower surface of the mounting piece portions, and the notched portions of the adjacent block members are mated with each other and are welded together.

* * * * *